US006220208B1

(12) United States Patent
van de Werve

(10) Patent No.: US 6,220,208 B1
(45) Date of Patent: Apr. 24, 2001

(54) COMBUSTION ENGINE HAVING A ROTATABLE CYLINDER BLOCK

(76) Inventor: Leon Ruben van de Werve, Gabriëlstraat 13, Arnhem (NL), 6813 KL ( * ) Notice: Subject to any disclaimer, the term of this patent is extended or adjusted under 35 U.S.C. 154(b) by 0 days.

(21) Appl. No.: 09/355,731

(22) PCT Filed: Feb. 6, 1998

(86) PCT No.: PCT/NL98/00074

§ 371 Date: Aug. 4, 1999

§ 102(e) Date: Aug. 4, 1999

(87) PCT Pub. No.: WO98/35147

PCT Pub. Date: Aug. 13, 1998

(30) Foreign Application Priority Data

Feb. 6, 1997 (NL) ..... 1005205
Feb. 6, 1997 (NL) ..... 1005206

(51) Int. Cl.[7] ..... F02B 57/08
(52) U.S. Cl. ..... 123/44 D; 91/491
(58) Field of Search ..... 123/44 D; 91/491

(56) References Cited

U.S. PATENT DOCUMENTS 3,991,728 11/1976 Vittert .

FOREIGN PATENT DOCUMENTS 3820033 12/1989 (DE) .
4119651 12/1992 (DE) .
565652 11/1944 (GB) .
44801 * 5/1916 (SE) ..... 123/44 D
8700574 1/1987 (WO) .

* cited by examiner

*Primary Examiner*—Michael Koczo
(74) *Attorney, Agent, or Firm*—Rothwell, Figg, Ernst & Manbeck

(57) ABSTRACT

Combustion engine of the Otto or diesel type, including a cylinder block having at least one cylinder in which a piston with a connecting rod connected thereto are movably provided. The at least one cylinder is arranged in a cylinder block which is rotatable about its axis and the end of the connecting rod remote from the piston is attached to a stationary shaft whose center line does not coincide with the center line of the axis of the rotatable cylinder block.

18 Claims, 1 Drawing Sheet

COMBUSTION ENGINE HAVING A ROTATABLE CYLINDER BLOCK

BACKGROUND OF THE INVENTION

1. Field of the Invention

The invention relates to a combustion engine of the Otto or diesel type, comprising a cylinder block having at least one cylinder in which a piston with a connecting rod connected thereto are movably provided.

2. Description of the Background

Today, such engines with their underlying principles are generally known and have a large number of applications. However, such engines have a number of principal drawbacks, the major drawback being the vibration level. Further, the space available for exchanging the gas mixture is limited and the maximum number of revolutions is inter alia limited both by the vibrational forces in connecting rods and pistons, and by the valves, whose dynamic behavior becomes the limiting factor at high speeds.

Moreover, in such engines, the number of parts is necessary for a proper operation is large, because distribution, valve mechanism, water pump, oil pump, ignition, valve control, etc. consist of a very large number of parts, which may of course all be subject to failure.

At present, there is a need for a combustion engine of the above-mentioned type in which considerably higher speeds are possible, while a better filling of the cylinder can be realized so that the performance per liter of contents increases considerably, and for which, if so desired, fewer parts may suffice. The invention provides such engine.

SUMMARY OF THE INVENTION

To this end, the combustion engine according to the invention is characterized in that the at least one cylinder is arranged in a cylinder block which is rotatable about its axis, and in that the end of the connecting rod remote from the piston is attached to a stationary shaft whose center line does not coincide with the center line of the axis of the rotatable cylinder block.

It is observed that in such engine according to invention, the gas mixture exchange can take place both by means of a conventional cylinder head with valves, and by means of a two-stroke system (without valves). However, in an advantageous manner, a system different herefrom is possible as well, to be described hereinbelow.

BRIEF DESCRIPTION OF THE DRAWING

Presently, the invention will be specified with reference to the accompanying drawings and the specification, by way of a non-limitative example.

FIG. 1 shows a cross section of a combustion engine according to the present invention.

DETAILED DESCRIPTION OF THE INVENTION

Figure 1:
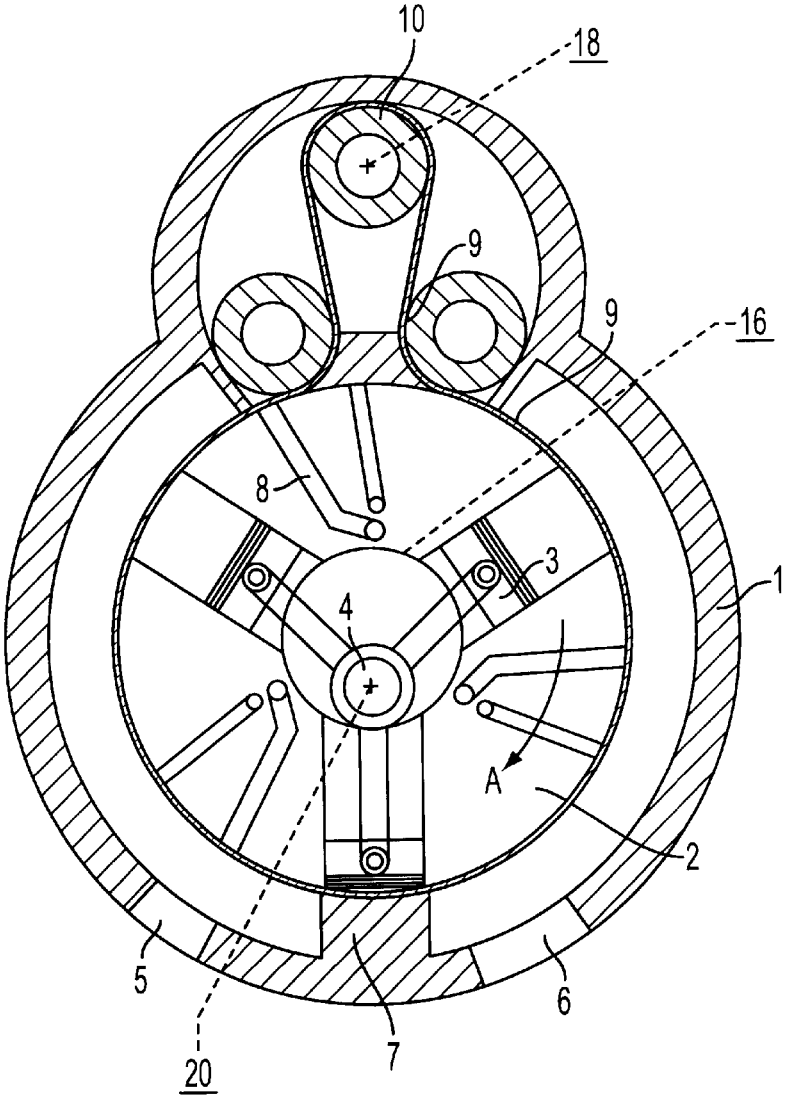
FIG. 1 shows a cross section of an advantageous embodiment according to the invention. In the Figure, a stationary housing 1 comprises a rotatable cylinder block 2 in which at least one cylinder 3 having a piston and a connecting rod is provided. (In the Figure, three cylinders are shown.)

The end of the connecting rod remote from the piston is attached to a stationary shaft 4 whose center line does not coincide with the center line of the rotatable cylinder block 2.

During operation of this combustion engine, the cylinder block 2 will rotate according to the arrow A. The housing 1 comprises an inlet port 5 and an outlet port 6. The housing 1 further contains a fixed place of ignition 7. The rotatable cylinder block is further provided with grooves 8 (for instance in radial direction) for cooling and lubricating purposes.

Figure 2:
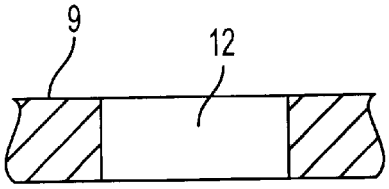
FIG. 2 shows an enlarged fragmentary cross section of a belt with an opening pattern for use in the engine.

In this embodiment, the side of the cylinder 3 remote from the stationary shaft 4 is open. Now, a means is present for periodically closing and releasing this open side of the cylinder, for instance in the form of an endless (preferably flexible) belt 9 bearing on the outer circumference of the rotatable cylinder block 2 and provided with an opening pattern for causing the "cylinder head" to be alternately present or absent. During one revolution of the cylinder, it is completely closed, and during the next revolution, it is entirely or partially open (depending on the opening pattern of the belt) at its top side. An opening pattern 12 in a portion of belt 9 is shown in FIG. 2. The belt 9 has a length which is preferably in a fixed ratio to the outer circumference of the cylinder block 2, and which is at least greater than this outer circumference. The opening pattern, in particular the number of openings, is chosen depending on the ratio between the belt length and the outer circumference on the one hand, and the number of cylinders 3 on the other. In this context, 'outer circumference' should be understood to mean the circumference of the bearing surface of the cylinder block on which the belt bears during use.

During use, the belt 9 preferably exhibits no slip relative to the outer circumference, so that in each case, a desired relationship between the belt 9 and the cylinders 3 is maintained. Accordingly, due to the ratio between the belt length and the outer circumference, the desired relative displacement of an opening relative to the cylinders is in each case obtained, for alternately opening and closing them.

In a possible advantageous embodiment of the invention, the belt, in operation, runs over the outer circumference of the rotatable cylinder block. Because of the continuous character of the fuel gas exchange, vibrations in the gas exchange system resulting from mass forces are largely eliminated. In the plane of the drive, rotational vibrations remain, which already exist on account of the combustion pulse. The vibrations now lie in one plane of rotation, because there are no up and down movements. The mass forces resulting from centrifugal forces can be taken up by balancing. Preferably, the belt 9 is 4/3× the outer circumference of the cylinder block and runs via one or more guiding rollers 10. The timing of the flexible belt 9 can take place in any manner suitable for that purpose, for instance by rendering the cylinder block 2 slightly conical, so that the circumference becomes variable and it is possible to always keep the belt in the proper position on the block by means of a cam system under spring pressure. Other manners of compensating an undesired positional change of the opening pattern relative to the cylinder block are possible as well, for instance by adjustment of the outer circumference of the cylinder block, adjustment of the length of the belt, or temporary, controlled slip of the belt relative to the cylinder block. In this manner, the synchronization and position relationship of the belt and the cylinder block, the timing, can be restored and/or maintained or adjusted.

In this manner, inter alia the cylinder head, camshaft(s), valves, valve springs, valve guides, valve adjusters, valve sealings, plunger rods, rockers, cylinder head gaskets and a large part of the distribution can be left out.

The water pump, oil pump and compressor, if any, for pressure charging the cylinder can advantageously be formed as centrifugal pump (not shown) by the rotating block 2 itself, for which only some sealings (not shown) are required. At the speeds of this engine (500–20,000 rpm), sufficient pressure is produced for oil, water and charging pressure. In this manner, in an advantageous embodiment of the invention, all oil pump parts, all water pump parts, a large part of the distribution and the vee ropes can be omitted.

In principle, per cylinder block, the ignition of the gas mixture takes place at one location only. Hence, only one ignition system is needed per cylinder block, as a result of which synchronization problems do not occur. Also, per cylinder block, only one gas mixture system (carburetor, injection system, etc.) and only one inlet and one outlet port are needed. Because of this, too, a large part of the distribution, of the injectors, plug leads, etc. can be left out in an advantageous embodiment of the invention. The pressure pulses in the inlet and outlet pieces are higher-frequent, which simplifies the noise damping. In principle, the operation of the ignition, mixture formation, motor management etc. can remain the same as is presently the case in known engines. A substantial additional advantage is that the engine according to the invention can be very short in the longitudinal axis, as a result of which in particular the incorporation thereof into automobiles can be very advantageous.

For the flexible belt 9, a material having high elasticity and high tensile strength at high temperatures is necessary, because the belt directly takes part in the combustion process. Steel having good thermal properties, composite materials, composite belts having an insulating intermediate layer and ceramic materials may be thought of.

Figure 3:
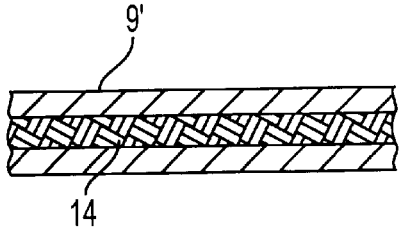
FIG. 3 shows an enlarged fragmentary cross section of a modified belt for use in the engine.

FIG. 3 shows a composite belt 9' having an intermediate insulating layer 14.

In an advantageous embodiment of the invention, in the case of two or more cylinders, the center lines of the cylinders in the cylinder block may be provided in one or more parallel planes.

The power take-off from the engine can inter alia take place directly from the rotating cylinder block 2 via take-off means 16, or via teeth thereof, or from one of the belt-guiding rollers via take-off means 18, or via induction as dynamo or as hydraulic pump. Of course, combinations are possible as well. In an engine according to the present invention, the compression ratio can be controlled, if so desired, by adjusting the center distance between the crank pin of each cylinder and the center line of the cylinder block using an adjustment means 20.

It is observed that for the sake of simplicity, ancillary units such as the dynamo, oil pump, water pump, oil flow-back system, ignition and mixture preparation are not shown in the Figure. As it is, they are based on known techniques and are known to skilled persons.

What is claimed is:

1. A combustion engine of the Otto or diesel type, comprising a cylinder block having at least one cylinder in which a piston with a connecting rod connected thereto are movably provided, wherein at least one cylinder is arranged in the cylinder block which is rotatable about its axis, the end of the connecting rod remote from the piston is attached to a stationary shaft whose center line does not coincide with the center line of the axis of the rotatable cylinder block, the side of the at least one cylinder which side is remote from the axis of the cylinder block, is open and wherein the rotatable cylinder block comprises a means for periodically closing and releasing the open side of the cylinder, characterized in that the means comprises a belt which is endless and flexible, said belt being provided with an opening pattern and bearing on at least a part of the outer circumference of the rotatable cylinder block.

2. A combustion engine according to claim 1, characterized in that the belt runs via at least one belt guiding roller.

3. A combustion engine according to claim 1, characterized in that the belt has a length greater than the outer circumference of the rotatable cylinder block.

4. A combustion engine according to claim 1, characterized in that, in operation, the belt runs over the outer surface of the rotatable cylinder block.

5. A combustion engine according to claim 1, characterized in that the belt consists of material of a high elasticity and a high tensile strength at high temperatures.

6. A combustion engine according to claim 1, characterized in that the belt consists of steel having good thermal properties.

7. A combustion engine according to claim 1, characterized in that the belt consists of composite material.

8. A combustion engine according to claim 1 characterized in that the belt consists of composite belts having an insulating intermediate layer.

9. A combustion engine according to claim 1, characterized in that the belt consists of ceramic material.

10. A combustion engine according to claim 1, characterized in that the rotatable cylinder block is accommodated in a stationary housing.

11. A combustion engine according to claim 10, characterized in that the stationary housing comprises an inlet port and an outlet port.

12. A combustion engine according to claim 10, characterized in that the rotatable cylinder block is provided with grooves for cooling and lubricating purposes.

13. A combustion engine according to claim 12, characterized in that the grooves extend radially.

14. A combustion engine according to claim 10, characterized in that the stationary housing comprises at least one location for ignition of the fuel mixture in the cylinder.

15. A combustion engine according to claim 1, characterized in that in the case of two or more cylinders, the center lines of the cylinders in the cylinder block are provided in one or more parallel planes.

16. A combustion engine according to claim 1, further comprising means tor taking-oft power from one of the rotatable cylinder block and at least one belt guiding roller.

17. A combustion engine according to claim 1, further comprising means for adjusting the distance between the center line of the rotatable cylinder block and the point ot engagement of the at least one connecting rod on the stationary shaft for controlling the compression ratio of the cylinders.

18. A combustion engine according to claim 16, wherein the means for taking-off power are selected from a group consisting of a dynamo and a hydraulic pump.

* * * * *